US005686792A

United States Patent [19]

Ensign, Jr.

[11] Patent Number: 5,686,792

[45] Date of Patent: Nov. 11, 1997

[54] EL LAMP WITH NON-LUMINOUS INTERCONNECTS

[76] Inventor: Thomas C. Ensign, Jr., 8426 E. Sorrel Trail, Scottsdale, Ariz. 85255

[21] Appl. No.: 548,053

[22] Filed: Oct. 25, 1995

[51] Int. Cl.[6] ..... H05B 33/00; H05B 33/02

[52] U.S. Cl. ..... 313/509; 313/510; 313/506

[58] Field of Search ..... 313/498, 509, 313/505, 506, 510

[56] References Cited

U.S. PATENT DOCUMENTS

| | | | |
|---|---|---|---|
| 2,919,366 | 12/1959 | Mash | 313/509 |
| 3,254,254 | 5/1966 | Buck, Jr. | 313/509 |
| 4,767,966 | 8/1988 | Simopoulos et al. | 313/509 |
| 5,266,865 | 11/1993 | Haizumi et al. | 313/509 |
| 5,508,585 | 4/1996 | Butt | 313/509 |

*Primary Examiner*—Nimeshkumar Patel
*Attorney, Agent, or Firm*—Paul F. Wille

[57] ABSTRACT

An electroluminescent lamp includes a continuous electroluminescent dielectric layer and a patterned rear electrode overlying the electroluminescent dielectric layer, wherein the rear electrode includes at least two conductive segments separated by a gap. An insulating layer fills the gap and a conductive interconnect overlies the insulating layer, joining the segments. The insulating layer spaces the interconnect from the electroluminescent dielectric layer a sufficient distance to reduce the electric field in the electroluminescent dielectric layer below the point at which the lamp appears luminous.

4 Claims, 1 Drawing Sheet

EL LAMP WITH NON-LUMINOUS INTERCONNECTS

BACKGROUND OF THE INVENTION

This invention relates to an electroluminescent (EL) lamp and, in particular, to an EL lamp having a patterned rear electrode wherein the segments of the rear electrode are electrically joined by non-luminous interconnects.

An EL lamp is essentially a capacitor having a dielectric layer between two conductive electrodes, one of which is transparent. The dielectric layer may include a phosphor powder or there may be a separate layer of phosphor powder adjacent the dielectric layer. As used herein, the term "electroluminescent dielectric layer" is generic for either construction. The phosphor powder radiates light in the presence of a strong electric field, using very little current. The front electrode is typically a thin, transparent layer of indium tin oxide or indium oxide and the rear electrode is typically a polymer binder, e.g. polyvinylidene fluoride (PVDF), polyester, vinyl, or epoxy, containing conductive particles such as silver or carbon. The front electrode is applied to a polymer film such as polyester or polycarbonate to provide mechanical integrity and support for the other layers.

It is known in the art to pattern the rear electrode to produce a luminous design when an EL lamp is lit. A problem with such lamps is that the pattern must be relatively simple; specifically, a pattern must not include any enclosed areas. For example, a circle within a circle can only be lit by connecting the two circles. A conductive bridge between the circles becomes part of the rear electrode and the phosphor glows under the bridge, producing stencil type letters, for example. One could pattern the phosphor layer to eliminate the luminous interconnection but patterning the phosphor layer requires that the phosphor layer and the rear electrode be accurately registered. Patterning a layer increases the cost of a lamp and requires registration between two or more layers further increases the cost of a lamp.

Contact to the electrodes is made in a variety of ways, such as forming an enlarged contact region along one edge of the lamp. In watch or timepiece applications, space is at a premium. The contact areas of the lamp cannot show through the watch face, requiring contact along the edges of the lamp. Another difficulty with timepieces is that different styles of watches require EL lamps of different shapes but the electronics driving the EL lamps can be identical for many styles of watch. In order to achieve the cost savings available from using identical electronics, it is desired that the terminals connecting an EL lamp to a power supply be in the same location regardless of the style of the watch or the design of the watch face.

In view of the foregoing, it is therefore an object of the invention to provide an EL lamp having non-luminous interconnects between a luminous area and a contact or between two luminous areas.

Another object of the invention is to provide an EL lamp having a continuous electroluminescent dielectric layer and non-luminous interconnects across dark regions of the lamp.

A further object of the invention is to provide EL lamps having different luminous designs but having contact areas at the same location relative to the design.

Another object of the invention is to provide a watch having at least one luminous area not containing an electrical contact for the area and a non-luminous interconnect between the contact and the luminous area.

SUMMARY OF THE INVENTION

The foregoing objects are achieved in the invention in which an electroluminescent lamp includes a continuous electroluminescent dielectric layer and a patterned rear electrode overlying the electroluminescent dielectric layer, wherein the rear electrode includes at least two conductive segments separated by a gap. An insulating layer fills the gap and a conductive interconnect overlies the insulating layer, joining the segments. The insulating layer spaces the interconnect from the electroluminescent dielectric layer a sufficient distance to reduce the electric field in the electroluminescent dielectric layer below the point at which the lamp appears luminous.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
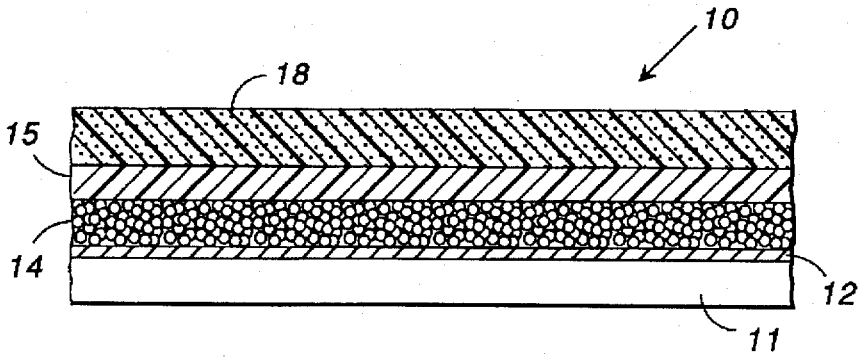
FIG. 1 (PRIOR ART)
FIG. 1 is a cross-section of an EL lamp constructed in accordance with the prior art.

FIG. 1 is a cross-section of an electroluminescent lamp constructed in accordance with the prior art. Lamp 10 includes substrate 11 made from polymer film such as polyester or polycarbonate. Transparent front electrode 12 is deposited on substrate 11. Phosphor layer 14 and dielectric layer 15, shown in FIG. 1 as separate layers, overlies front electrode 12. Rear electrode 18 overlies dielectric layer 15 and is made from a polymer binder containing graphite. Rear electrode 18 is typically opaque and is the side of lamp 10 facing away from a viewer. The relative thicknesses of the layers are not drawn to scale.

Applying alternating current between rear electrode 18 and front electrode 12 through suitable contacts (not shown) produces an electric field across phosphor layer 14, causing the phosphor layer to emit light. The intensity of the light emission is, at a first approximation, linearly proportional to field strength (voltage) and linearly proportional to the frequency of the alternating current.

Figure 2:
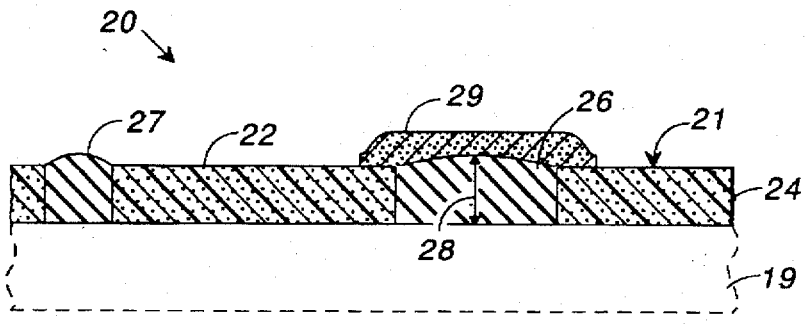
FIG. 2 is a cross-section of an EL lamp with a non-luminous interconnect constructed in accordance with the invention.

FIG. 2 illustrates EL lamp 20 constructed in accordance with a preferred embodiment of the invention in which the rear electrode is patterned to produce the desired graphics when the lamp is lit. The substrate, front electrode, and electroluminescent dielectric layer are made in the same way as for lamps of the prior art and are represented by dashed line 19. Rear electrode 21 is preferably screen printed and is patterned to include a plurality of gaps, such as gap 26 between segment 22 and segment 24. In accordance with the invention, the gaps between segments in rear electrode 21 are filled with a suitable insulator, such as UV curable resin.

Gaps 26 and 27 are filled with insulator after rear electrode 24 is printed and cured. Gaps 26 and 27 are filled for example by screen printing or by roll coating, i.e. by flowing liquid polymer across the surface of rear electrode 24 and removing polymer from portions 22 and 24 with a doctor blade or squeegee. The insulating material is cured and conductive interconnect 29 is then printed over gap 26 and over the adjoining edges of segments 22 and 24. Interconnect 29 is preferably the same material as segments 22 and 24, thereby avoiding problems of compatibility and assuring strong adherence between interconnect 29 and the underlying segments.

A voltage applied to segment 24 is coupled to segment 22 by interconnect 29. The electric field produced under segments 22 and 24 is proportional to the applied voltage. The electric field under interconnect 29 is substantially less than the electric field under segment 22 or segment 24 because the interconnect is spaced further from the electroluminescent dielectric layer by the insulator in gap 26.

Rear electrode 21 is approximately the same thickness as rear electrode 18 (FIG. 1). If the electroluminescent dielectric layer includes separate phosphor and dielectric layers, the dielectric layer has a thickness of about 20μ, and rear electrode 21 has a thickness of about 45μ. Thus, interconnect 29 is spaced about three times as far from the phosphor layer as the rear electrode. The reduced field across thickness 28 causes light emission that is undetectable under normal operation conditions, i.e. the area under the interconnect appears dark. At low field intensities, light emission is non-linearly proportional to the applied voltage, which further reduces the intensity of the emitted light.

Figure 3:
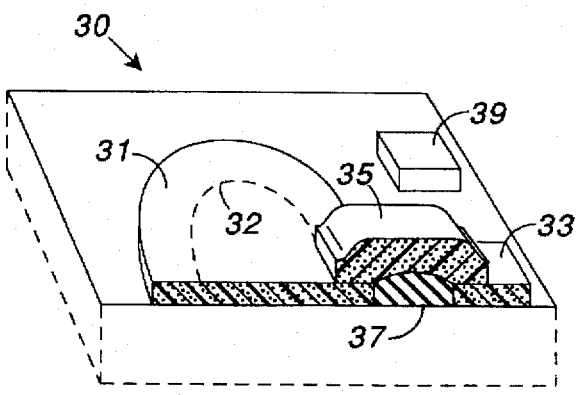
FIG. 3 is a perspective view of a portion of an EL lamp strip including a non-luminous interconnect constructed in accordance with the invention.

FIG. 3 illustrates a portion of an EL lamp in which a patterned rear electrode is coupled to a terminal by a non-luminous interconnect constructed in accordance with the invention. In FIG. 3, rear electrode 31 is coupled to terminal 33 by conductive interconnect 35 overlying insulator 37. Terminal 39 is electrically connected to the front electrode (not shown). In accordance with one aspect of the invention, terminals 33 and 39 can be located at a predetermined location, independently of the design or pattern formed in rear electrode 31. In this way, the printed circuit board for a watch can have contacts formed at a corresponding location and the board can be used for a plurality of visually distinct lamps.

The embodiment of FIG. 3 operates in the same manner as the embodiment of FIG. 2. A voltage applied to terminals 33 and 39 causes lamp 30 to glow in the areas covered by rear electrode 31. The area under interconnect 35 appears dark because the electric field is substantially lower under the interconnect than under rear electrode 31. Rear electrode 31 can have any desired shape and can be a hollow figure, as indicated by dashed line 32.

Figure 4:
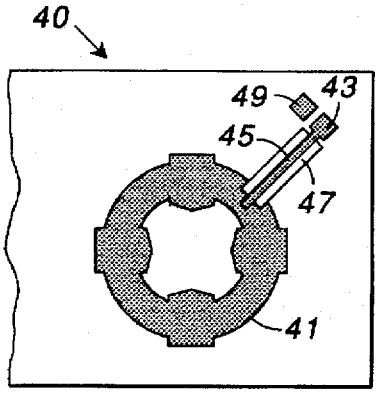
FIG. 4 is a plan view of an EL lamp strip for a watch, showing the rear electrode and interconnect constructed in accordance with the invention.

FIG. 4 is a plan view of the rear electrode of an EL lamp constructed in accordance with the invention for backlighting the dial of a watch. A plurality of such lamps is constructed in a strip or panel and the lamps are separated from each other during assembly of the watches. Lamp 40 includes rear electrode 41 coupled to terminal 43 by conductive interconnect 45 overlying insulator 47. Terminal 49 is connected to the front electrode (not shown) of EL lamp 40. In this embodiment of the invention, insulating layer 47 overlies a portion of electrode 41.

Conductive interconnect 45 is raised above the plane of electrode 41 and the electric field between interconnect 45 and the front electrode is substantially less than the electric field between rear electrode 41 and the front electrode. Thus, the area underneath interconnect 45 appears non-luminous when a voltage is applied to terminals 43 and 49. If rear electrode 41 included two concentric rings, each ring could be separately powered or the inner ring could be connected to the outer ring by interconnect 45.

The invention thus provides an EL lamp having a continuous electroluminescent dielectric layer and non-luminous interconnects between a luminous area and a contact or between two luminous areas. Lamp terminals are at the same location on a lamp, independent of the particular pattern of the rear electrode.

Having thus described the invention, it will be apparent to those of skill in the art that various modifications can be made within the scope of the invention. For example, although it is an advantage of the invention that materials and steps from existing processes can be used to implement the invention, the invention is not limited to such implementation. For example, it is not required that the insulator be a different material from the rear electrode. The polymer binder used for rear electrode layer 21, without the graphite particles, can be used as the insulator. Complex patterns can be made by chaining together segments of the rear electrode with conductive interconnects. Alternatively, a plurality of segments of the rear electrode can be powered by individual conductive interconnects.

What is claimed as the invention is:

1. An electroluminescent lamp comprising:

a transparent first electrode;

a second electrode having a predetermined thickness;

an electroluminescent dielectric layer between said first electrode and said second electrode;

wherein said second electrode is divided into at least two segments separated by a gap at which said lamp is not luminous when lit;

an insulating layer in said gap;

a conductive interconnect overlying a portion of said insulating layer between said segments;

whereby the electroluminescent dielectric layer is luminous at said segments when a voltage is applied across said first electrode and said second electrode but is not luminous at said interconnect when a voltage is applied across said first electrode and said second electrode.

2. The lamp as set forth in claim 1 wherein said insulating layer has a thickness substantially equal to said predetermined thickness.

3. The lamp as set forth in claim 1 and further including:

at least one terminal separated from said segments by said gap; and a conductive interconnect between one of said segments and said terminal.

4. The lamp as set forth in claim 1 wherein said lamp includes separate dielectric and phosphor layers and said conductive interconnect is separated from said phosphor layer by a distance that is at least twice the distance between said rear electrode and said phosphor layer, whereby the electric field between said conductive interconnect and said front electrode is substantially less than the electric field between said rear electrode and said front electrode.

* * * * *